United States Patent [19]

Bischof et al.

[11] Patent Number: 5,040,340

[45] Date of Patent: Aug. 20, 1991

[54] RANDOM ORBITAL SANDER ADAPTER

[75] Inventors: Dennis B. Bischof; Hans A. Schmidt, both of Brooks, Me.

[73] Assignee: Marshco Products, Inc., Brooks, Me.

[21] Appl. No.: 577,766

[22] Filed: Aug. 29, 1990

[51] Int. Cl.[5] ..... B24B 23/02

[52] U.S. Cl. ..... 51/170 MT; 51/169

[58] Field of Search ..... 51/170 R, 170 MT, 170 T, 51/168, 169

[56] References Cited

U.S. PATENT DOCUMENTS

| | | | |
|---|---|---|---|
| 2,706,875 | 4/1955 | Higley | 51/170 MT |
| 2,794,303 | 6/1957 | Wickes | 51/170 MT |
| 2,922,261 | 1/1960 | Rabkin et al. | 51/170 T |
| 3,482,362 | 12/1969 | Bangerter et al. | 51/170 R |
| 4,924,636 | 5/1990 | Hoffman | 51/170 MT |

FOREIGN PATENT DOCUMENTS

| | | | |
|---|---|---|---|
| 1078618 | 6/1980 | Canada | 51/170 T |
| 2745129 | 4/1979 | Fed. Rep. of Germany | 51/170 MT |
| 3120871 | 12/1982 | Fed. Rep. of Germany | 51/170 T |
| 1235789 | 6/1971 | United Kingdom | 51/170 MT |

*Primary Examiner*—Roscoe V. Parker
*Attorney, Agent, or Firm*—Fish & Richardson

[57] ABSTRACT

An adapter for converting a right angle grinder into a random orbital sander which employs a sanding pad assembly, the right angle grinder having a threaded output shaft, the adapter including a cylindrical body having a bearing aperture on its front side and a threaded bore for screwing onto the threaded output shaft on its back side, the axis of the threaded bore corresponding to the axis of the cylindrical body; a bearing assembly fitted into the bearing aperture so that as to establish a second axis of rotation that is parallel to but offset from the axis of the cylindrical body; an attachment for attaching the sanding pad assembly to the bearing assembly so that the sanding pad assembly can rotate freely about the second axis; a counterweight mounted on the front side of the cylindrical body so as to be located relative to measurement along the cylindrical axis at a position that is between the center of mass of the bearing assembly and the sanding pad assembly when the sanding pad assembly is connected to the attachment means, the counterweight providing both static and dynamic balance for the adapter; and a locking mechanism located on the side of the bearing assembly that is opposite to the side on which the sanding pad assembly is mounted, the locking mechanism for preventing the attachment from rotating while the sanding pad assembly is attached to and/or disassembled from the attachment.

7 Claims, 2 Drawing Sheets

RANDOM ORBITAL SANDER ADAPTER

BACKGROUND OF THE INVENTION

The invention relates to random orbital sanders.

Random orbital sanders are commonly used for sanding, grinding, polishing and other types of surface treatment. One might typically find them in automotive shops and in other shops where finishing is done. Random orbital sanders are different from conventional rotary sanders and generally serve a different purpose. Whereas conventional rotary sanders are often used primarily for material removal and rough work, random orbital sanders are better suited for finish work requiring a finish without the circular scratches often caused by the rotary sander.

Random orbital sanders are so named because of the motion imparted to the sanding pad during operation. In a conventional rotary sander, the sanding pad assembly is attached directly to the rotating drive shaft of the tool and thus, the sanding pad rotates with the shaft to generate purely circular motion. In a random orbital sander, the sanding pad is attached to a second shaft that is parallel to, but offset from, the rotating drive shaft of the tool. The sanding pad is free to rotate about the axis of the second shaft independently of the rotation of the drive shaft. Since the second shaft, and thus the sanding pad, are eccentrically positioned relative to the drive shaft, the entire sanding pad assembly follows an orbital path when the drive shaft rotates. When the sanding pad of a random orbital sander is applied to a work surface, the sanding pad rotates about the second axis in a pattern dictated by the complex forces applied to the pad by the workpiece and which can best be described as random. Thus, the name random orbital sander.

SUMMARY OF THE INVENTION

In general, in one aspect, the invention is an adapter for converting a right angle grinder into a random orbital sander which employs a sanding pad assembly. The adapter includes a cylindrical body having a bearing aperture on its front side and a threaded bore for screwing onto the threaded output shaft of a right angle grinder on its back side, the axis of the threaded bore corresponding to the axis of the cylindrical body; a bearing assembly fitted into the bearing aperture so that as to establish a second axis of rotation that is parallel to but offset from the axis of the cylindrical body; means for attaching the sanding pad assembly to the bearing assembly so that the sanding pad assembly can rotate freely about the second axis; a counterweight mounted on the front side of the cylindrical body so as to be located relative to measurement along the cylindrical axis at a position that is between the center of mass of the bearing assembly and the sanding pad assembly when the sanding pad assembly is connected to the attachment means, said counterweight providing both static and dynamic balance for said adapter; and a locking mechanism located on the side of the bearing assembly that is opposite to the side on which the sanding pad assembly is mounted, the locking mechanism for preventing the attachment means from rotating while the sanding pad assembly is attached to and/or disassembled from the attachment means.

Preferred embodiments include the following features. The adapter body is machined from a solid block of aluminum. The counterweight has an outer perimeter that generally conforms to and is within the circular outer perimeter of the front side, it is secured to the adapter body with the aid of at least one blind drive screw rivet, and it comprises a material that is more dense than aluminum. The bearing assembly has an inner race that includes an inner bore. The attachment means is a cylindrically-shaped insert having a rim at one end and a threaded hole at the opposite end for receiving a threaded post of the sanding pad assembly. The insert is held within the inner bore of the bearing assembly and the rim has a diameter larger than the inner bore. In addition, the head is slotted and the cylindrical body has a radially oriented hole which aligns with the slot when the head is rotated to a predetermined orientation. The hole in the adapter body is for receiving a pin that can slide into the slot and prevent the insert from rotating.

One advantage of the invention is that it readily converts a right angle grinder into a random orbital sander thereby increasing the usefulness of that grinding tool and eliminating the need to also have a dedicated random orbital sanding tool in the shop. In addition, the invention achieves a low profile thereby reducing the total mechanical amplification of machining errors and making it possible to more easily achieve an exceptionally small runout for the sanding pad. The lower runout leads to less vibration and permits the adapter to run at very high speeds such as are often found on some right angle grinders, e.g. 10,000 RPM. The invention also achieves both dynamic and static balance through the use of a single counterweight which is placed between the centers of mass of the sanding pad assembly and the bearing assembly, the two primary contributors to off-axis weight which require counterbalancing. The location of the counterweight also minimally adds to the overall height of the adapter and yet does not create a potential hazard to users by extending outside of the perimeter of the main body of the adapter. Furthermore, the invention features a locking mechanism to aid in assembly and disassembly and which adds only minimally to the overall height of the adapter.

These and other features and advantages of the invention will be seen from the following description of a preferred embodiment, and from the claims.

DESCRIPTION OF THE PREFERRED EMBODIMENT

STRUCTURE

Figure 1:
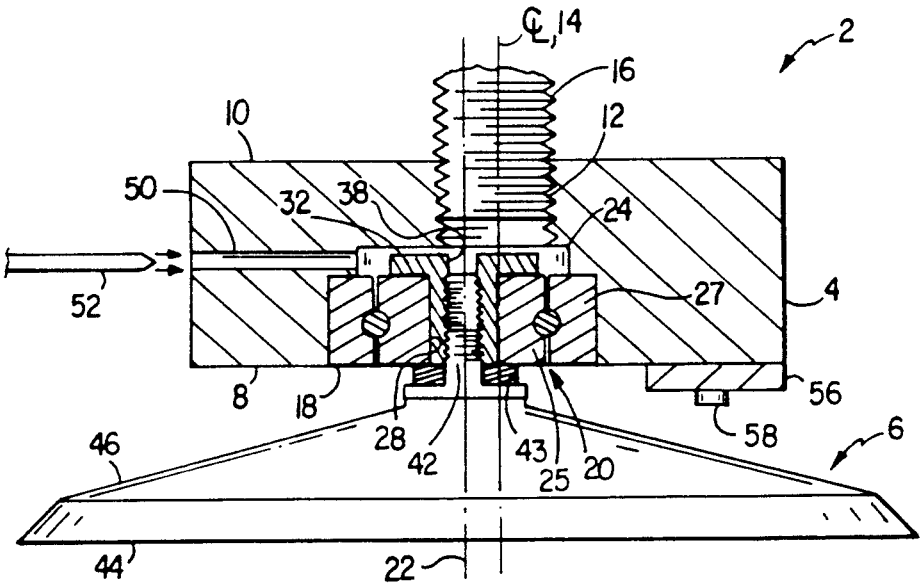
FIG. 1 is a side cross-sectional view of a random orbital sander adapter with an attached sanding pad assembly.

As shown in FIG. 1, a low-profile adapter 2 for converting a right angle grinder (not shown) to a random orbital sander includes a cylindrically shaped adapter body 4 and a sanding pad assembly 6. Adapter body 4 has front surface 8, a back surface 10 and a threaded bore 12 passing into body 4 through back surface 10 and aligned along the cylindrical axis 14 of body 4. Threaded bore 12 allows adapter body 4 to be screwed onto a threaded output shaft 16 of a right angle grinder. In the described embodiment, threaded bore 12 has, for example, a $\frac{5}{8}$-11 thread size, which corresponds to that commonly available on many commercially available right angle grinders.

Figure 2:
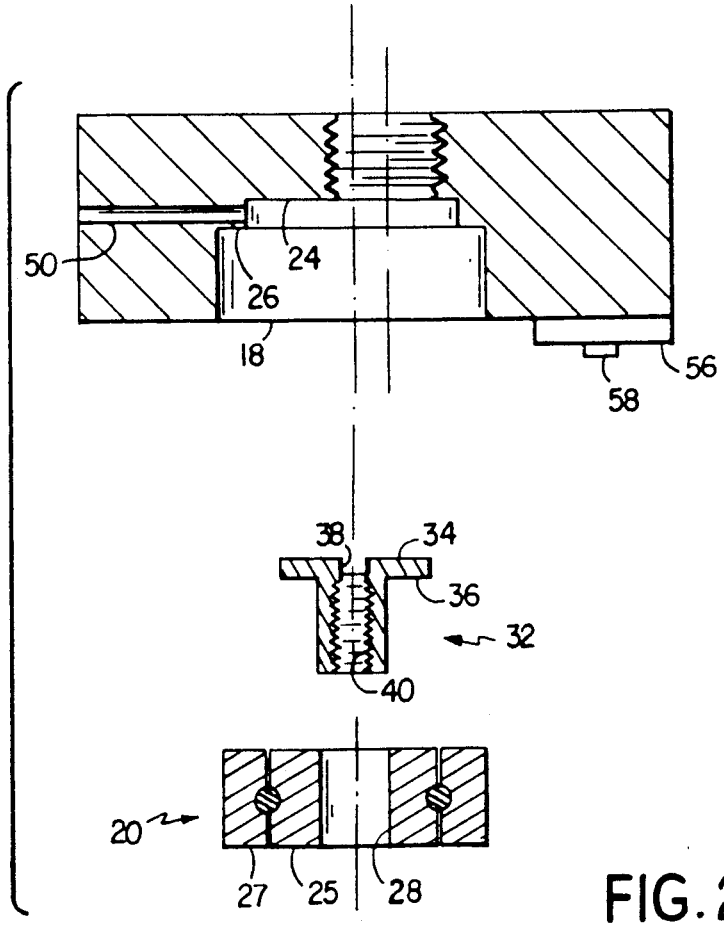
FIG. 2 is an exploded view including the adapter body, the bearing assembly and the insert shown in FIG. 1.

As shown more clearly in the exploded view of FIG. 2, adapter body 4 also includes a cylindrically shaped aperture 18 (referred to as a bearing aperture 18) for holding a bearing assembly 20. The cylindrical axis 22 of bearing aperture 18 is parallel to, but offset from, cylindrical axis 14 of adapter body 4. Thus, when bearing assembly 20 is assembled into bearing aperture 18, it is eccentrically positioned with respect to the axis of rotation of adapter body 4. Bearing aperture 18 has a bottom surface 24 with a surrounding annular shoulder 26.

Bearing assembly has an inner race 25, an outer race 27 and a central bore 28. In the described embodiment, bearing assembly 20 is a standard commercially available 6202-2RS ball bearing having a sealed face. Central bore 28 holds a cylindrical insert 32 having a diameter that is slightly less than central bore 28 so that it can be easily inserted into bearing assembly 20. At one end of insert 32, there is a head 34 having diameter larger than that of the insert so as to form a rim 36 extending circumferentially around insert 32. A slot 28, perpendicular to and intersecting the cylindrical axis of insert 32, is cut through head 34 to a depth slightly greater than the thickness of head 34. Also, extending through the center and aligned with the cylindrical axis of insert 32 is a threaded hole 40.

Sanding pad assembly 6 is a commercially available item, preferably of the low profile type so as to minimize the overall height of the assembled adapter 2. It includes a threaded post 42 and a pad 44 mounted on a stiff backing support 46. In the described embodiment, sanding pad assembly 6 has a 5 inch sanding pad 44 made of polyurethane foam having sufficient stiffness so as not to significantly distort during operation at high speed, e.g., 10,000 RPM. Typically, a sanding disc (not shown) is attached to the front surface of pad 44 with the aid of an adhesive.

As illustrated by FIG. 2, to assemble adapter 2, insert 32 is slid into bearing assembly 18 until rim 36 rests against one face of bearing assembly 20. Then, bearing assembly 20 is press fit into bearing aperture 18 until it seats against shoulder 26. The height of shoulder 26 is such as to prevent head 34 of insert 32 from contacting bottom surface 24 when bearing assembly 20 is fully inserted into bearing aperture 18. Thus, insert 32 and the inner race of bearing assembly 20 is able to freely rotate without binding against bottom surface 24 of aperture 18. In addition, the depth of aperture 18 is such that the face of the fully inserted bearing assembly 20 is nearly flush with front surface 8 of adapter body 4.

After bearing assembly 20 is fully pressed into aperture 18, sanding pad assembly 6 is attached to adapter 2 by screwing threaded post 42 into threaded hole 40 of insert 32. A spacer washer 43 is used on threaded post 42 to assure that no binding occurs either between counterweight 56 and the backside of sanding pad assembly 6 or at bearing assembly 20. In the described embodiment, the clearance between the counterweight 56 and the back of sanding pad assembly 6 is about 0.03 inch.

Figure 3:
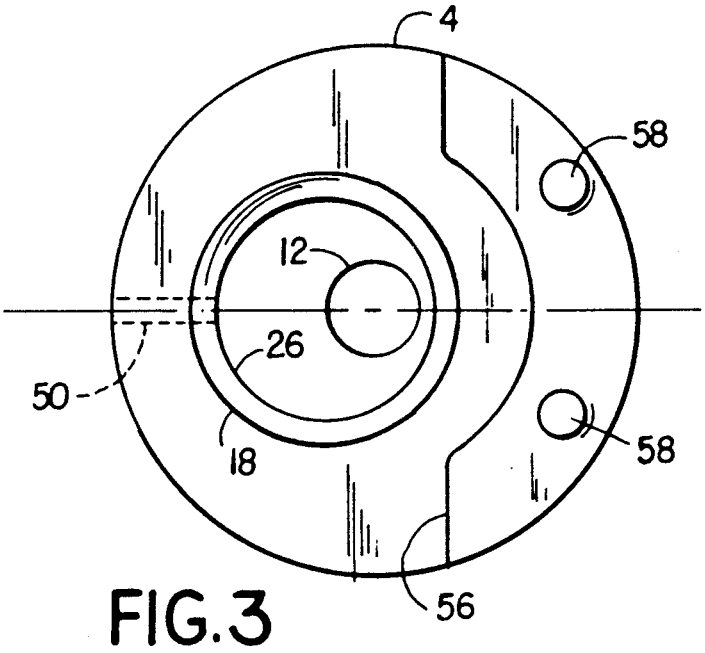
FIG. 3 is a top view of the adapter body shown in FIG. 1.

As shown in FIGS. 1, 2, and 3, adapter body 4 includes a hole 50 drilled along a radius perpendicular to its cylindrical axis and extending into bearing aperture 18. Hole 50 is for receiving a pin 52 that passes into slot 38 of insert 32 when insert 32 is properly aligned. Pin 52 serves to lock insert 32 into preselected position thereby preventing it from rotating while sanding pad assembly 6 is either screwed onto or disassembled from adapter 2. A locking mechanism located behind bearing assembly 20, rather than between bearing assembly 20 and sanding pad assembly 6, is one of several design features which permits sanding pad assembly 6 to be mounted more closely to front face 8 of adapter body 4 so as to achieve a low profile and thus superior performance for the overall random orbital sanding head assembly.

To establish both static and dynamic balance for adapter 2, a crescent-shaped counterweight 56 having an outer perimeter with the same radius of curvature as cylindrical body 4 is attached to front face 8 with the aid of two flat headed, blind drive screw rivets 58. Counterweight 56 is positioned on front surface 8 so that its outer perimeter conforms with the curvature of cylindrical body 4 and it is located on the opposite side of front surface 8 from where bearing aperture 18 is located so as to counterbalance the combined weight of bearing assembly 20 and sanding pad assembly 6. In addition, to further minimize its height, counterweight 56 is made from a dense material such as, for example, 11 gauge cold-rolled steel. Thus, it rises only about 0.118 inch off of front surface 8. Moreover, relative to measurement along rotational axis 14 of adapter 4, counterweight 56 is located between the center of masses of the two primary components which require counterbalancing, namely, sanding pad assembly 6 and bearing assembly 20. Because of its placement, both static and dynamic balance is achievable with this single counterweight.

The overall design of adapter 2 achieves a low profile for the product, thus making it possible to more easily minimize the runout (or wobble) at the edge of sanding pad assembly 2. Runout is the maximum distance that the outer edge of sanding pad 44 varies in the axial direction when both adapter body 4 and sanding pad assembly 6 are rotated. In the described embodiment, for example, adapter body 4, from back surface 10 to front surface 8 is approximately 1 inch high and has a diameter of approximately 2.75 inches. When sanding pad assembly 6 is assembled onto adapter body 4, the overall height of adapter 2 is approximately 1.75 inches. With the design described herein, a total runout of about 0.005 inch is readily achievable, assuming that a sanding pad assembly of sufficiently high quality is used.

Adapter body 4 is machined from a solid block of aluminum, rather than cast, to avoid possible nonuniformities in density that may cause balance problems. The machining occurs in the following order. Starting with a rough sawn block of aluminum, a cylindrically-shaped body is formed on a lathe. Next, front surface 8 is machined flat and bearing aperture 18 is drilled into the block, both steps being performed as part of the same machine operation without removing the aluminum block from the machine. Care must be taken to keep the plane of front surface 8 perpendicular to axis 14 and to assure that axis 22 of bearing aperture 18 is parallel to axis 14. In the described embodiment, bearing aperture 18 is offset from axis 14 by 0.156 inch.

After front surface 8 and bearing aperture 18 have been machined, the block of aluminum is turned around and the backside of adapter body 4 is machined. As with the other end of adapter 4, both back surface 10 and threaded bore 12 are formed as part of the same machine operation. That is, all steps including the machining of back surface 10, and the drilling, countersinking and tapping of threaded bore 12 are performed without removing the aluminum block from the machine which performs these operations. This aids in achieving close tolerances on the finished product. For example, a face to face runout on adapter 4 of less than 0.001 inch is readily achievable.

When front surface 8 is machined, a dimple is formed on the side of the cylinder. This dimple is the location at which hole 50 is later drilled and serves as a reference point for all operations including the placement of holes for rivets 58, the placement of counterweight 55 and the stamping of any identification information onto adapter 4.

Other embodiments of the invention are within the following claims.

What is claimed is:

1. An adapter for converting a right angle grinder into a random orbital sander which employs a sanding pad assembly, the right angle grinder having a threaded output shaft, the adapter comprising:

a cylindrical body having a bearing aperture on its front side and a threaded bore for screwing onto the threaded output shaft on its back side, the axis of said threaded bore corresponding to the axis of said cylindrical body;

a bearing assembly fitted into said bearing aperture so that as to establish a second axis of rotation that is parallel to but offset from the axis of said cylindrical body;

means for attaching the sanding pad assembly to the bearing assembly so that the sanding pad assembly can rotate freely about the second axis;

a counterweight mounted on the front side of said cylindrical body so as to be located relative to measurement along the cylindrical axis at a position that is between the center of mass of said bearing assembly and said sanding pad assembly when said sanding pad assembly is connected to said attachment means, said counterweight providing both static and dynamic balance for said adapter; and a locking mechanism located on the side of said bearing assembly that is opposite to the side on which the sanding pad assembly is mounted, said locking mechanism for preventing the attachment means from rotating while the sanding pad assembly is attached to and/or disassembled from said attachment means.

2. The adapter of claim 1 wherein said adapter body is machined from a solid block of aluminum.

3. The adapter of claim 1 wherein said counterweight has an outer perimeter that generally conforms to and is within the circular outer perimeter of the front side.

4. The adapter of claim 3 wherein said counterweight comprises a material that is more dense than aluminum.

5. The adapter of claim 4 further comprising at least one blind drive screw rivet holding said counterweight onto the front side of said cylindrical body.

6. The adapter of claim 1 for use with a sanding pad assembly that includes a threaded post for attaching the sanding pad assembly to a tool and wherein the bearing assembly has an inner race that includes an inner bore and said attachment means is a cylindrically-shaped insert having a rim at one end and a threaded hole at the opposite end for receiving the threaded post of the sanding pad assembly, the rim having a diameter larger than the inner bore of said bearing assembly, said insert being held within said inner bore.

7. The adapter of claim 6 wherein the head of said insert is slotted and said cylindrical body has a radially oriented hole which aligns with said slot when said head is rotated to a predetermined orientation, said hole for receiving a pin that can slide into said slot and prevent said insert from rotating, said hole and said slot forming said locking mechanism.

* * * * *